United States Patent [19]

Schuit

[11] 4,332,229

[45] Jun. 1, 1982

[54] DOUBLE INTAKE, SUPERCHARGING I.C. ENGINE

[76] Inventor: Johannes Schuit, 1433 Camino Trillado, Carpenteria, Calif. 93013

[21] Appl. No.: 162,117

[22] Filed: Jun. 23, 1980

[51] Int. Cl.[3] ..... F02B 33/10

[52] U.S. Cl. ..... 123/65 B; 123/57 R; 123/57 B; 123/71 R; 123/74 R

[58] Field of Search ..... 123/310, 71 R, 74 R, 123/57 B, 57 R, 57 A, 65 B

[56] References Cited

U.S. PATENT DOCUMENTS

| | | | |
|---|---|---|---|
| 827,759 | 8/1906 | Smith | 123/74 R |
| 874,634 | 12/1907 | St. Germain | 123/57 B |
| 966,972 | 8/1910 | Wiebe | 123/74 R |
| 976,858 | 11/1910 | Easthore, Jr. | 123/57 B |
| 1,001,600 | 8/1911 | Adams | 123/57 B |
| 1,378,254 | 5/1921 | MacDonald | 123/74 R |
| 1,479,953 | 1/1924 | Bray | 123/71 R |
| 1,548,705 | 8/1925 | Blake | 123/74 A |
| 1,999,092 | 4/1935 | Fisher | 123/74 R X |
| 2,025,202 | 12/1935 | Harper, Sr. | 123/310 |
| 2,051,204 | 8/1936 | Elwell | 123/57 B |
| 2,131,216 | 9/1938 | Brooke | 123/57 B X |
| 2,324,705 | 7/1943 | Huber | 123/310 |
| 4,185,597 | 1/1980 | Cinquegrani | 123/71 R |

FOREIGN PATENT DOCUMENTS

| | | | |
|---|---|---|---|
| 2308127 | 9/1974 | Fed. Rep. of Germany | 123/74 R |
| 278489 | 10/1930 | Italy | 123/57 B |

*Primary Examiner*—Wendell E. Burns
*Attorney, Agent, or Firm*—William W. Haefliger

[57] ABSTRACT

An I.C. engine has a block, the engine forming a bore and having a crankshaft. The engine includes:

(a) first and second pistons that reciprocate in that bore,
(b) connection structure interconnecting the pistons, the pistons operatively connected to the crankshaft,
(c) valve casing structure operatively coupled to the block, there being a first zone in the bore between the casing structure and one piston, and a second zone between the casing structure and the other piston,
(d) the valves associating with the casing structure adapted to pass intake air into one of such zones and to exhaust compressed air out of the other of the zones in response to piston movement in one direction, and adapted to pass intake air into the other of the zones and to exhaust compressed air from that one zone in response to piston movement in the opposite direction.

18 Claims, 11 Drawing Figures

DOUBLE INTAKE, SUPERCHARGING I.C. ENGINE

BACKGROUND OF THE INVENTION

This invention relates generally to engines, air compression and supercharging; and more particularly concerns a highly efficient engine wherein no external, engine-driven air compressor or supercharger is required, but rather these functions are incorporated within the basic engine structure to provide a highly compact, efficient engine of simple design.

There is a continuing need for reliable, efficient internal combustion engines, and especially those which are economic as respects fuel consumption. While many engines have been designed in efforts to achieve these goals, none to my knowledge have incorporated the unusual features of construction and modes of operation as are characteristic of the present invention, and which uniquely approach such goals.

SUMMARY OF THE INVENTION

It is a primary objective of the invention to incorporate air compressing functions within the engine itself, such air then being usable for supercharging or other purposes. By virtue of such internalizing of air compression, a unique engine braking arrangement, as well as additional functions, may be provided, as will be seen.

Accordingly, and in accordance with the invention, the engine basically includes a block providing a reciprocating piston bore or bores, and comprises:

(a) first and second pistons that reciprocate in said bore, (b) connection means interconnecting said pistons, the pistons operatively connected to the crank shaft, (c) valve casing structure operatively coupled to the block, there being a first zone in the bore between the casing structure and one piston, and a second zone between the casing structure and the other piston, (d) the valves associated with the casing structure adapted to pass intake air into one of said zones and to exhaust compressed air out of the other of said zones in response to piston movement in one direction, and adapted to pass intake air into the other of said zones and to exhaust compressed air from said one zone in response to piston movement in the opposite direction.

Further, and as will be seen, the casing structure may comprise two valve casings coupled to the block and extending into the bore at opposite sides of a passage that receives the reciprocating connector extending between the pistons. Each casing typically has opposed walls respectively adjacent the air compressing zones referred to, the valves are advantageously in the form of reed valves, and they operate to pass intake air alternately into those two zones for compression therein as the pistons reciprocate, the compressed air then passing through other reed valves in a casing to exhaust to an accumulator, or to a compressed air receiver, as will appear.

Additional objects include the provision of valving to control the escape of compressed air, for controllably braking the engine; the construction of the accumulator to swirl a fuel air mixture for supercharging delivery to the engine air intake port; the provision of piston and engine head shapes to enhance swirling in the combustion chamber and to control flame propagation; and the provision for cooling of the working piston, as will be seen.

These and other objects and advantages of the invention, as well as the details of an illustrative embodiment, will be more fully understood from the following description and drawings, in which:

DRAWING DESCRIPTION

Figure 1:
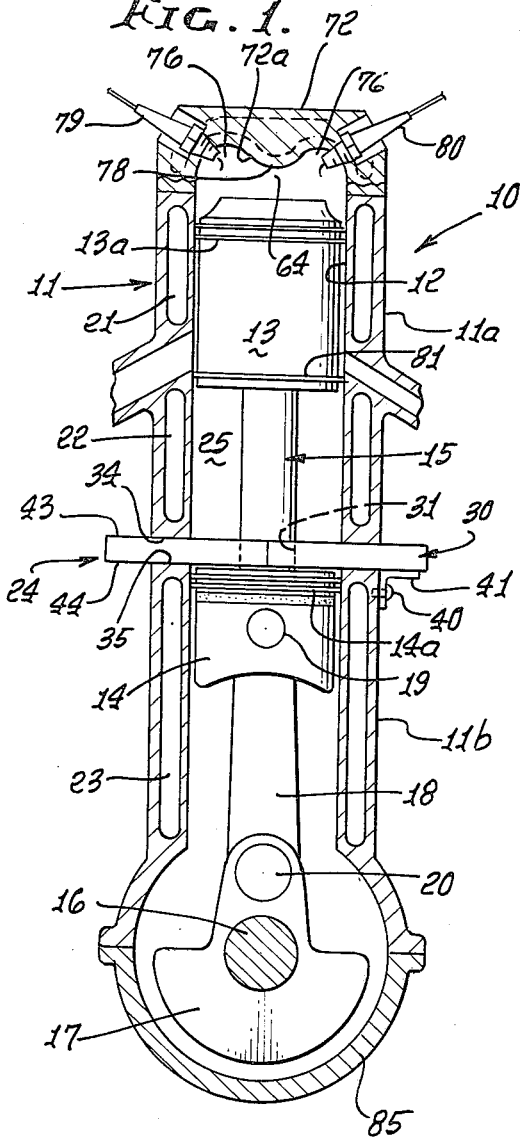
FIG. 1 is an elevation taken through an engine embodying the invention, with piston at top dead center.
Figure 8:
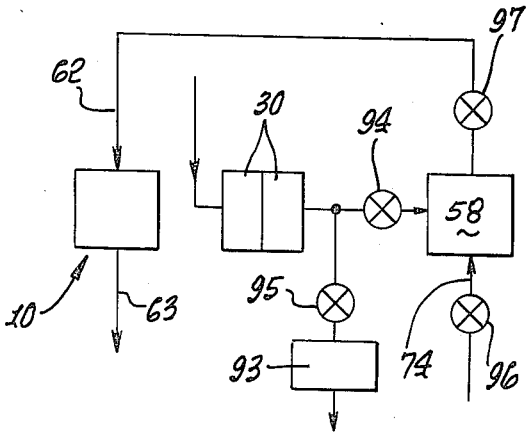
Figure 4:
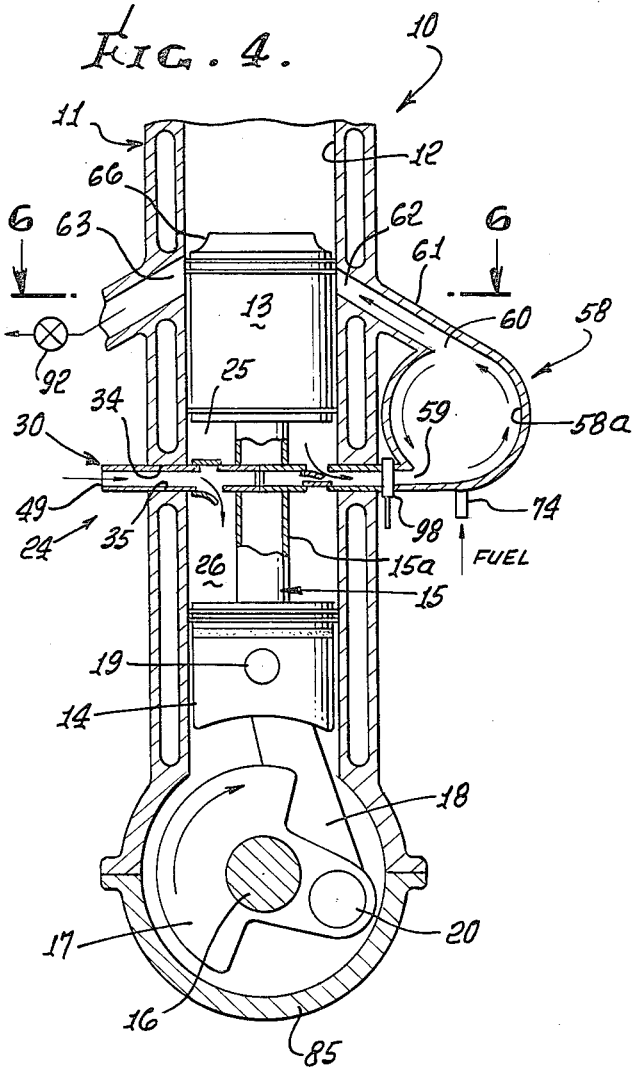
FIG. 4 is a view like FIG. 2, but showing use of an accumulator.
Figure 5:
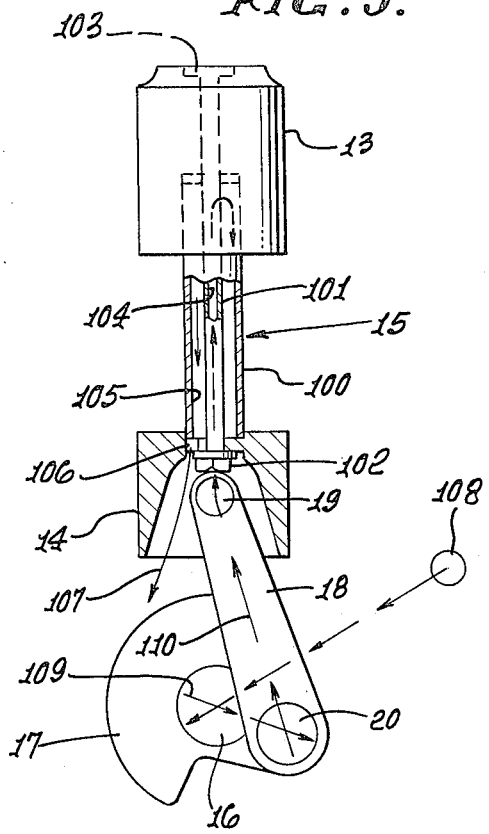
Figure 6:
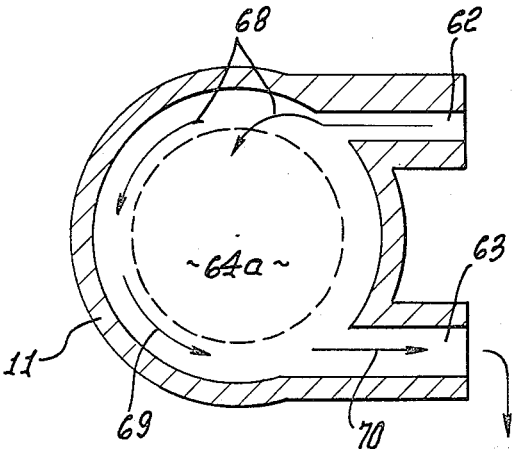
Figure 7:
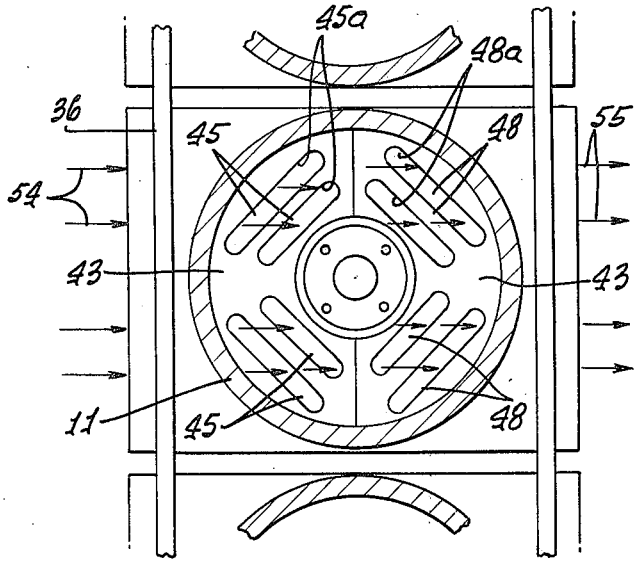
Figure 9:
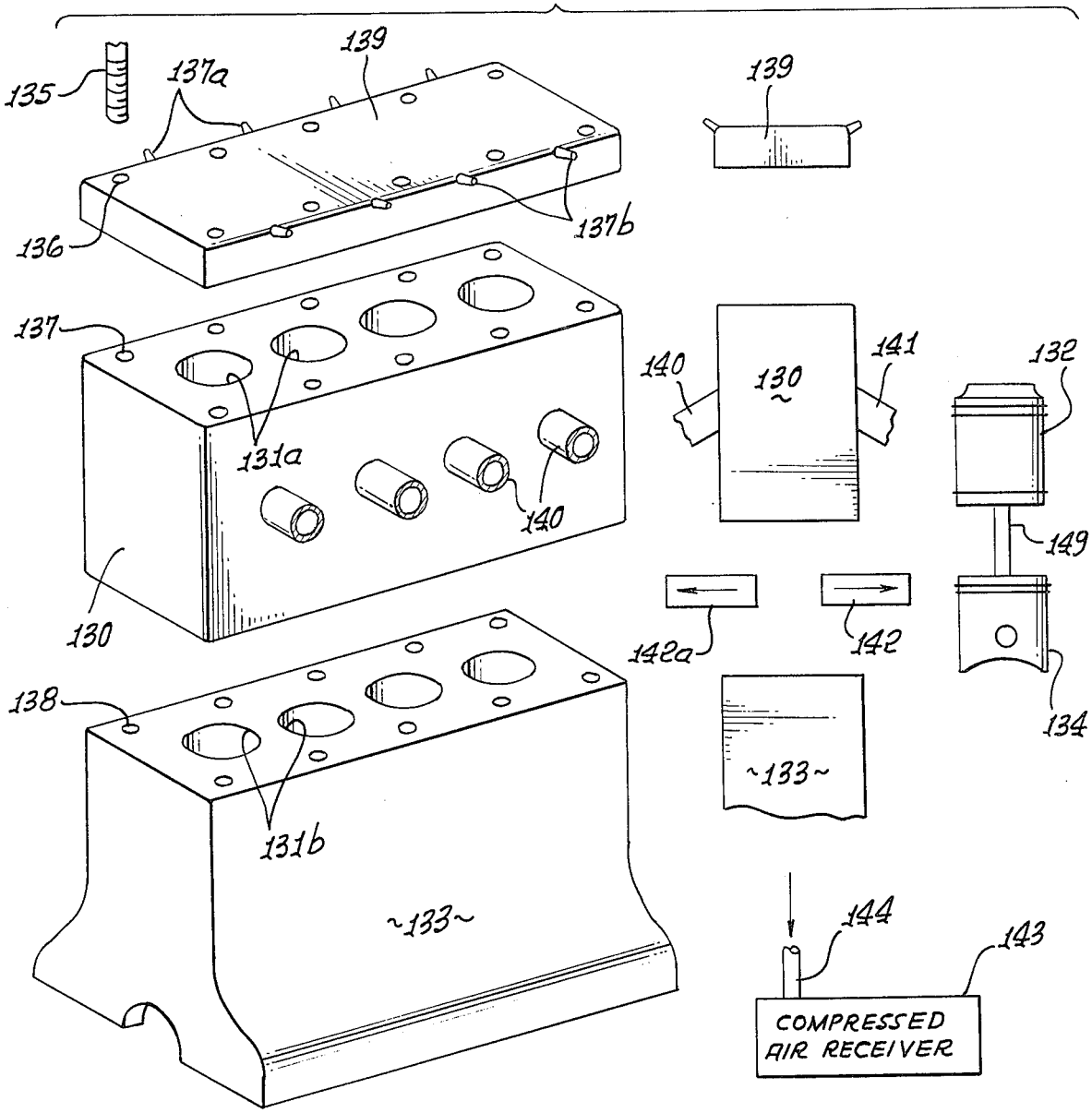
Figure 4A:
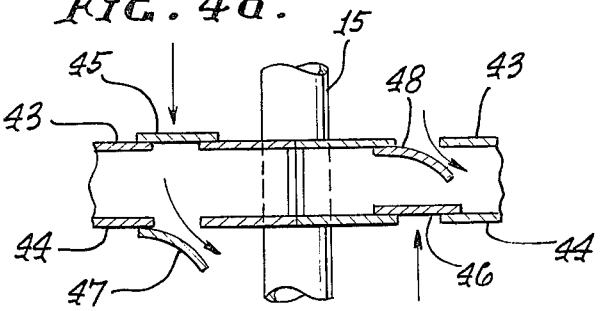
Figure 4B:
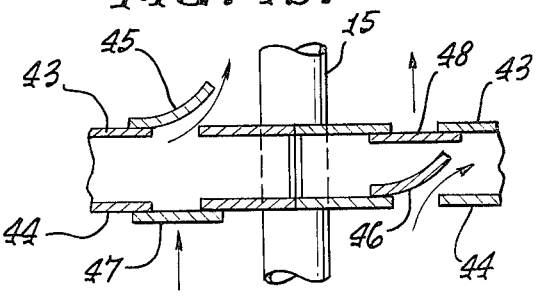

FIGS. 4*a* and 4*b* are schematics showing valve operation;

FIG. 5 is a vertical elevation showing details of connection structure between the engine piston and crankshaft;

FIG. 6 is a section taken on lines 6—6 of FIG. 1;

FIG. 7 is a plan view of valve casings incorporating reed valves, assembled to an engine;

FIG. 8 is a flow diagram showing use of the accumulator to deliver air for external use; and FIG. 9 is an exploded view of an engine embodying the invention.

DETAILED DESCRIPTION

Figure 2:
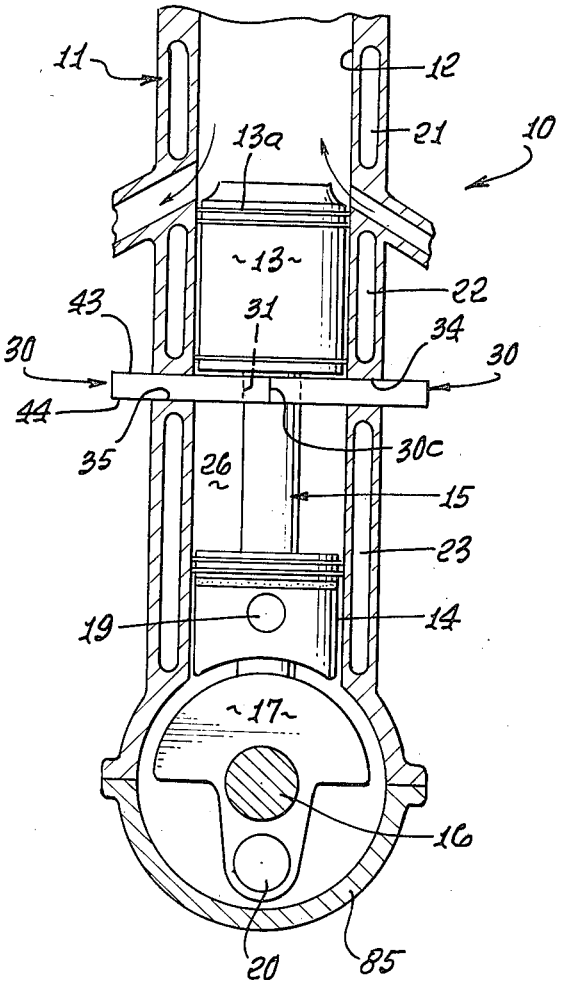
FIG. 2 is a view like FIG. 1, showing the piston at bottom dead center.
Figure 3:
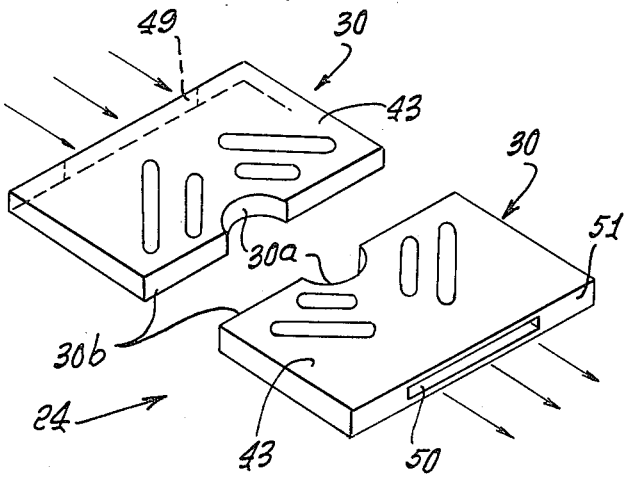
FIG. 3 is a perspective showing of two valve casings used in the engine of FIGS. 1 and 2.

In FIGS. 1, 2 and 4, a two-stroke cycle, internal combustion engine 10 includes an engine block 11 with a cylinder bore 12. More than one bore may, of course, be provided. First and second pistons 13 and 14 are reciprocable in the bore 12, and they may have the same or different piston diameters, corresponding to the bore dimensions which they fit. Suitable piston rings 13*a* and 14*a* may be provided. Structure to interconnect the pistons appears at 15; an engine crankshaft is shown at 16 and suitably counterweighted at 17; and a connecting link or rod is shown at 18 to connect the piston assembly with the crankshaft, as via bearings 19 and 20. Suitable cooling is provided, and may take the form of liquid or water jacket passages 21–23 in the block. Also note crankcase 85.

In accordance with an important aspect of the invention, valve or valve casing structure, as for example at 24, is operatively coupled or connected to the block; a first zone 25 is defined or formed in the cylinder between the structure 24 and the upper piston 13; and a second zone 26 is defined or formed in the cylinder between structure 24 and the lower piston 14. As will be seen, that valve structure is adapted to pass intake air into one of said zones and to exhaust compressed air out of the other of said zones in response to piston movement in one direction, and adapted to pass intake air into the other of said zones and to exhaust compressed air from said one zone in response to piston movement in the opposite direction.

The valve casing structure may, with unusual advantage, take the form of the two like casings 30 seen in FIGS. 1–4 and 7, which are removably coupled to the engine block to extend into the bore cylinder and at opposite sides of the piston connection 15. The latter may take the form of a tube having a cylindrical outer wall 15*a* interfitting the semi-cylindrical walls 30*a* formed by the casings 30. Suitable seals may be formed by that interfit, or by auxiliary sealing structure at that interfit locus. Walls 30*a* form a passage 31 to pass tube 15. Also, the casings 30 have straight walls 30*b* which interfit one another at locus 30*c*, in bore 11. The two casings have upper and lower like and flat walls 43 and 44 which sealingly interfit end walls 34 and 35 of the cylinder, about bore 11, when the casings are placed in position. Auxiliary structure to hold the block upper and lower sections 11*a* and 11*b* in position is indicated generally at 36 in FIG. 7; alternately, the block may be slotted, sidewardly, to receive the casings. One means to hold the casings in position is indicated by fastener 40 in FIG. 1, attaching a casing bracket 41 to the block 11. Other attachment means are usable.

More specifically, each casing 30 typically has opposed walls, such as upper and lower transverse walls 43 and 44; respectively adjacent zones 25 and 26. The above referenced valves associated with the casings may advantageously comprise reed valves carried by walls 43 and 44. See for example first and third reed valves 45 and 47 carried by respective walls 43 and 44 of one casing, and second and fourth reed valves 46 and 48 carried by the respective walls 43 and 44 of the second casing. Referring to FIGS. 4*a* and 4*b*, first reed valve 45 passes suction air from the interior of the first casing into first zone 25 (see FIG. 4*b*), while second reed valve 46 passes compressed air from second zone 26 into the interior of the second casing, all during the upstroke of the piston assembly. Suction air enters the first casing via intake port 49 and compressed air discharges from the second casing via discharge port 50 (see FIG. 3). Alternately, during the down stroke of the piston assembly (see FIG. 4*a*), third reed valve 47 opens to pass suction air from the interior of the first casing into second zone 26; and fourth reed valve 48 opens to pass compressed air from zone 25 into the interior of the second casing. Again, such intake air enters the first casing via intake port 49, and compressed air discharges from the second casing via discharge port 50 in end wall 51. Note in FIGS. 3 and 7 the organization and arrangement of reed valves 45 and 48. Ports 45*a* and 48*a* are formed in walls 43 in association with those valves. Valves 46 and 47 are similarly arranged in association with lower walls 44 of the casings, as well as similar ports in those walls. In FIG. 7, intake suction air-flow is indicated by arrows 54, and compressed air discharge by arrows 55.

The compressed air may be used in various ways. For example, means may be provided to couple to the casing structure and to the engine to supply the exhausted compressed air to the engine air intake, for combustion with fuel in the engine. One such means is shown in FIG. 4 as incorporating an accumulator 58 having air intake 59 connected at 60 to second casing wall 51, and a discharge 60 coupled by duct 61 to engine air intake port 62. The engine is shown to have an exhaust port 63 intersecting bore 12 above piston 13 at a slightly higher level than intake port 62, whereby the contents of the combustion zone 64 commence exhaustion by pressure relief and discharge through port 63 prior to pressurized air intake into the combustion zone. The accumulator has an interior wall 58*a* which is curved, and may be cylindrical as shown, to effect rapid swirling of the compressed air therein prior to its sudden discharge through duct 61 and port 62 as the latter is uncovered. This adds to the kinetic energy of the intake air blasted into the combustion zone for efficient scavenging of the combustion products from that zone and exhausting at 63. Further, the top of the piston 13 is circumferentially chamfered at 66 to direct the entering air upwardly and around the piston, producing swirling in the combustion zone for reducing hot spots and efficient downward flow and out the exhaust port. See FIG. 6, showing tangential in-flow at 68 of compressed air, swirl around the piston and in the zone 64, indicated by arrows 69, and outflow at 70 via exhaust port 63.

The velocity of the air fuel mixture will have a marked influence on the flame propagation, i.e. the higher the velocity of swirl, the slower the propagation, so that a low octane fuel may be utilized without the problem of detonation.

An air fuel mixture may be lean as the heavier fuel will be cast to the cylinder wall and the perimeter of the combustion chamber where ignition will take place.

Since the air fuel mixture will be rich at the perimeter and lean at the center of working cylinder, ignition will take place at the perimeter, at two points, 180 degrees apart, so that the flame front will meet at the center. The combustion chamber being shaped, that is, low in the center and high at the perimeter, enhances the flame propagation.

FIG. 4 also shows the provision of a fuel intake, such as fuel jet 74, located to supply fuel to the air subjected to swirling in the accumulator, for thorough and intimate mixing of air and fuel prior to delivery to intake port 62. The accumulator also serves to eliminate the air pulses produced by compressed air delivery by pistons 13 and 14 to the valve casings. That pulse-free mixture is then introduced into the combustion zone 64 and compressed by the piston 13 as it moves upwardly in the combustion chamber 64, as seen in FIG. 1. Smooth supercharging is thereby achieved. The engine head 72 covering zone 64 has a wall 72*a* facing that zone, that wall forming annular recess 76 and with a downwardly convex dome 78. Spark plugs 79 and 80 have points exposed to the interiors of those respective recesses, to ignite the mixture and drive the piston 13 downwardly, together with piston 14 and the rod 18, to rotate the crankshaft.

The working piston 13 is typically longer than the stroke of a given engine, as the piston will have sealing rings 13*a* at the combustion chamber end, and sealing rings 81 at the induction end. The piston must be of such length so that the lower sealing rings come up to but do not pass the exhaust and intake ports at the top of the stroke, as shown in FIG. 1.

A greater than one atmospheric pressure in the working chamber 64, supercharged, can be accomplished by a controlled restricted exhaust system. As the pumping cylinders 25 and 26 are of the positive displacement type, a ten P.S.I, exhaust pressure will result in a twenty-four P.S.I. working chamber pressure prior to the compression stroke. Valve 92 in FIG. 4 indicates an exhaust control for this purpose.

A pure air compressor can be obtained by directing the bulk of the air from the pumping cylinders to an air receiver 93 seen in FIG. 8. Only a required amount of air is passed on to the accumulator via valve 94, to keep the engine operating. See also control valves 95–97. If the engine is to be used only as an air compressor, the crankshaft may be of a more economical quality, as there will be no motive torque and is used only to return the piston assembly to complete the compression stroke, lubrication and cooling.

Gasoline may be used as a fuel, introduced at the intake side of the reed valve assembly utilizing a standard carburator, however, if the engine is to be used as air compressor, direct fuel injection into the working cylinder is needed, as fuel may find its way into the air receiver via the pumping cylinders. The engine may also be operated as a diesel, either by direct injection or a precombustion chamber.

An effective brake may be obtained by a controlled closing of the duct that leads from the pumping cylinder to the accumulator, causing a great deal of pressure to build up in the pumping cylinders, stopping piston movement and thus crankshaft rotation. See in this regard valve 98, used for this purpose, in FIG. 4.

Referring to FIG. 5, the connector means to interconnect the pistons may include inner and outer elongated tubular members extending between the pistons. See for example outer tube 100 the ends of which are seated in recesses in the pistons, and inner tubular member 101 received in member 100. Member 101 may comprise a hollow bolt or fastener attached at 102 and 103 to the piston. Means to cool the working piston 13 may comprise fluid coolant circulation passages 104 and 105 in members 101 and 100, coolant flowing for example upwardly in bolt passage 104, thus exiting to splash against the inner wall of tube 100 in piston 13, and then flowing downwardly in passage 105 to exit via port 106 downwardly at 107 into the oil pan. Pump 108 supplies coolant via ports 109 and 110 in the crankshaft and rod 18 to passage 104 in the fastener.

Finally, it should be noted that valve 98 (controlling delivery of compressed air to the accumulator) can be selectively adjusted (manually or automatically) so as to control the compression ratio in the combustion chamber 64. For example, if the engine is used to power an automobile, that ratio can be adjusted to around 6/1 at start-up (or high load conditions) and can be converted to 12/1 at cruising speed of the vehicle (i.e. reduced load conditions). This should avoid "detonation" problems, as might be encountered otherwise.

Escape of combustion gases into the crankcase to contaminate the lubricating oil with acids etc. is all but impossible as the gases must pass two sets of sealing rings and two induction systems rendering lubricating oil changes virtually unnecessary.

In FIG. 9, the illustrated two-stroke engine block assembly (corresponding to block 11) includes a first section 130 having a first portion or portions 131*a* of the bore or bores 131, to receive the first piston or pistons 132 (corresponding to piston 13 in FIG. 1). The block also includes a second section 133 having a second portion or portions 131*b* of the bore or bores 131, to receive the second piston or pistons 134 (corresponding to piston 14 in FIG. 1). The block sections are suitably interconnected as via bolts 135 receivable in openings 136, 137 and 138, as shown. Openings 136 are formed in a head 139 (corresponding to head 72 in FIG. 1), the head attached to the top of block 130. Openings 137 and 138 are formed in block sections 130 and 133. The piston are interconnected at 149 and corresponding to connection 15 in FIG. 6. Spark plugs 137*a* and 137*b* correspond to plugs 79 and 80, above.

Air or fuel induction ports 140 correspond to ports 62 in FIG. 1, and combusted gas exhaust ports 141 correspond to ports 63 in FIG. 1, ports 140 and 141 located in block section 130. Reed valve casings 142 and 142*a* correspond to like casings 30, as described above, and their relationship to the block section is also the same as described. Compressed air discharged from casing 142*a* is delivered to a receiver or vessel 143, as via line 144 coupled to casing 142*a*.

The block second section 133 defines a second zone or zones (corresponding to zone 26 referred to above), and said block second section 133 may comprise a pre-existing (or used) block body (as from an automobile engine for example) from which the head has been removed. The block first section 130 defines a first zone or zones (corresponding to zone 25 referred to above), and section 130 may comprise an added or new block body attached to the pre-existing body. Therefore, the invention enables simple conversion of an engine into an air (or other gas) compressor. To this end, reciprocating engines now in existence may be used as an inexpensive approach to the manufacture of air compressors, as the basic cylinder block assembly, crankshaft, connecting rods etc. may be utilized, with the addition of a two stroke cylinder block assembly, cylinder head, piston assemblys and reed valves, high performance engines may be produced in this manner as for the racing field.

I claim:

1. In a two-stroke I.C. engine having a block, the engine forming a bore and having a crankshaft, the combination comprising (a) first and second pistons that reciprocate in said bore, (b) connection means interconnecting said pistons, the pistons operatively connected to the crankshaft, (c) valve casing structure operatively coupled to the block, there being a first zone in the bore between the casing structure and one piston, and a second zone between the casing structure and the other piston, (d) the valves associating with the casing structure adapted to pass intake air into one of said zones and to exhaust compressed air out of the other of said zones in response to piston movement in one direction, and adapted to pass intake air into the other of said zones and to exhaust compressed air from said one zone in response to piston movement in the opposite direction, (e) said casing structure including two casings coupled to the block and extending into the bore and at opposite sides of a passage within which said connection means passes and reciprocates, the casings having interfitting edges portions extending crosswise of said zones, the casings together forming said passage and each extending part way about said connection means, (f) one of said pistons compressing an air-fuel mixture in an engine combustion chamber, the block having intake and exhaust outlet ports associated with and at the side of said combustion chamber, and which are both uncovered by the sides of said one piston during part of its stroke, (g) and means including an accumulator coupled to the casing structure and to the intake port to supply said exhausted air under pressure to the combustion chamber for combustion with fuel in said combustion chamber.

2. The combination of claim 1 wherein each casing has opposed walls respectively adjacent said first and second zones, said valves comprise reed valves carried by said walls and include (i) a first reed valve to pass suction intake air into said first zone from the interior of that first casing and a second reed valve to pass compressed air from the second zone into the interior of the second casing, all in response to piston movement in one direction, and (ii) a third reed valve to pass suction intake air into the second zone from the interior of the first casing and a fourth reed valve to pass compressed air from the first zone into the interior of the second casing, all in response to piston movement in the opposite direction.

3. The combination of claim 1 wherein the accumulator has an interior wall which is curved to effect swirling of air therein, and there being a fuel intake located to supply fuel to the air subject to swirling in the accumulator, for mixing prior to delivery to the intake port.

4. The combination of claim 1 including means coupled to the engine to controllably restrict exhaustion of air from the casing structure, thereby to effect controllable braking of the engine.

5. The combination of claim 3 wherein a duct couples the casing structure to the accumulator, and including a braking valve associated with said duct to controllably restrict delivery of exhaust air to the accumulator, thereby to effect controllable braking of the engine.

6. The combination of claim 1 wherein the engine has a combustion zone at the top of one of the pistons and with which said intake and outlet ports communicate, the intake port located in relation to the one piston to cooperate therewith to produce swirling of intake air in the combustion zone.

7. The combination of claim 6 wherein the engine has a head end toward which said one piston moves to compress air in said combustion zone, said head end having a wall facing said zone, said wall forming two recesses and a cusp therebetween, there being spark plugs with points exposed to the interiors of said two recesses.

8. The combination of claim 7 wherein the one piston has a head end facing said recessed wall, said head end having a peripheral chamfer.

9. The combination of claim 6 wherein said one piston is longer than the stroke of said reciprocating pistons.

10. The combination of claim 1 including means to cool said one piston.

11. The combination of claim 10 wherein said connection means includes inner and outer elongated tubular members extending between said pistons, and said means to cool said one piston includes coolant circulation passages in said members.

12. The combination of claim 1 including a compressed air receiver coupled to said casing structure to receive compressed air therefrom.

13. The combination of claim 1 wherein said engine block included a first section having a first portion of said bore to receive the first piston, and a second section having a second portion of said base to receive the second piston, said sections being interconnected.

14. The combination of claim 13 wherein said block second section defines said second zone, and comprises a pre-existing block body from which the head has been removed.

15. The combination of claim 14 wherein said block first section defines said first zone, and comprises an added block body attached to said pre-existing block body.

16. The combination of claim 13 including a compressed air receiver coupled to said valve casing structure to receive compressed air therefrom.

17. In a two-stroke I.C. engine having a block, the engine forming a bore and having a crankshaft, the combination comprising (a) first and second pistons that reciprocate in said bore, (b) connection means interconnecting said pistons, the pistons operatively connected to the crankshaft, (c) valve casing structure operatively coupled to the block, there being a first zone in the bore between the casing structure and one piston, and a second zone between the casing structure and the other piston, (d) the valves associating with the casing structure adapted to pass intake air into one of said zones and to exhaust compressed air out of the other of said zones in response to piston movement in one direction, an adapted to pass intake air into the other of said zones and to exhaust compressed air from said one zone in response to piston movement in the opposite direction, (e) one of said pistons compressing the air-fuel mixture in an engine combustion chamber, the block having air intake and exhaust outlet ports associated with said combustion chamber and which are both uncovered by the one piston during part of its stroke, (f) means including an accumulator coupled to the casing structure and to the engine to supply said exhausted air under pressure to the engine air intake port for combustion with fuel in said combustion chamber, (g) and means coupled to the engine to controllably restrict exhaustion of combustion products from said exhaust outlet port.

18. In an I.C. engine having a block, the engine forming a bore and having a crankshaft, the combination comprising (a) first and second pistons that reciprocate in said bore, (b) connection means interconnecting said pistons, the pistons operatively connected to the crankshaft, (c) valve casing structure operatively coupled to the block, there being a first zone in the bore between the casing structure and one piston, and a second zone between the casing structure and the other piston, (d) the valves associated with the casing structure adapted to pass intake air into one of said zones and to exhaust compressed air out of the other of said zones in response to piston movement in one direction, and adapted to pass intake air into the other of said zones and to exhaust compressed air from said one zone in response to piston movement in the opposite direction, (e) one of said pistons compressing the air fuel mixture in an engine combustion chamber for combustion, and including means to cool said one piston, (f) said connection means including inner and outer elongated tubular members extending between said pistons, and said means to cool said one piston including coolant circulation passages in said members.

* * * * *